United States Patent [19]

O'Brien et al.

[11] Patent Number: 4,761,127

[45] Date of Patent: Aug. 2, 1988

[54] APPARATUS FOR WASTE ENCAPSULATION

[75] Inventors: Michael J. O'Brien, Shevington; Robert B. Rigg, Walton, both of England

[73] Assignee: British Nuclear Fuels Plc, Risley, England

[21] Appl. No.: 4,481

[22] Filed: Jan. 20, 1987

[30] Foreign Application Priority Data

Jan. 28, 1986 [GB] United Kingdom ..... 8602080

[51] Int. Cl.[4] ..... G21F 9/36

[52] U.S. Cl. ..... 425/110; 100/269 A; 252/628; 252/633; 254/93 HP; 264/0.5; 425/456

[58] Field of Search ..... 425/110, 125, 432, 456, 425/111, 112; 249/105; 264/0.5; 252/626, 628, 629, 633; 100/269 A; 254/93 HP; 501/155

[56] References Cited

U.S. PATENT DOCUMENTS

| | | | |
|---|---|---|---|
| 4,275,869 | 6/1981 | Clements | 254/93 HP |
| 4,341,915 | 7/1982 | Adachi et al. | 264/0.5 |
| 4,395,213 | 7/1983 | Springs et al. | 425/432 |
| 4,629,587 | 12/1986 | Monden et al. | 252/633 |

FOREIGN PATENT DOCUMENTS

| | | | |
|---|---|---|---|
| 2421142 | 11/1975 | Fed. Rep. of Germany | 252/628 |
| 2536699 | 4/1976 | Fed. Rep. of Germany | 252/628 |
| 59-162491 | 9/1984 | Japan | 252/628 |
| 60-135794 | 7/1985 | Japan | 252/628 |
| 61-26900 | 2/1986 | Japan | 252/633 |

*Primary Examiner*—Jay H. Woo
*Assistant Examiner*—James C. Housel
*Attorney, Agent, or Firm*—William R. Hinds

[57] ABSTRACT

A drum to receive waste, in particular radioactive waste, and an encapsulating material such as cement is located on a vibratable platform beneath a charge chute. The platform is mounted on an inflatable support, conveniently a plurality of air cushions, operable to lift and maintain the drum in sealing engagement about the charge chute during filling of the drum. Vibration means on the platform vibrate the drum and its contents without breaking the sealing engagement.

3 Claims, 1 Drawing Sheet

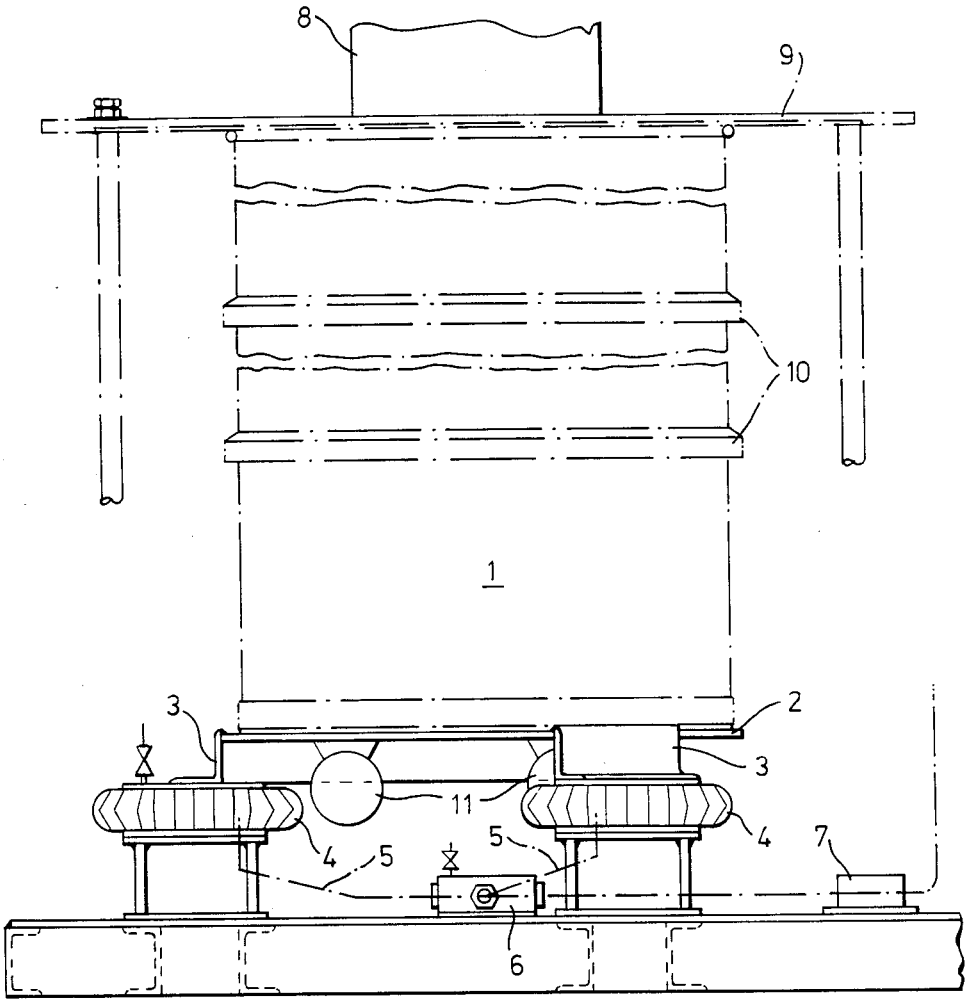
8
9
10
1
3
2
3
11
4
4
5
5
7
6

APPARATUS FOR WASTE ENCAPSULATION

The present invention concerns apparatus for use in the encapsulation of harmful waste products, in particular radioactive wastes.

It is known to introduce wastes into a drum and to add a cement or grout whereby to form solid blocks suitable for subsequent storage or disposal. For satisfactory results it is required to obtain thorough mixing of the contents of the drum before solidification.

According to the present invention an apparatus for the encapsulation of harmful waste products, such as radioactive wastes, comprises a drum formed with axially compressible rolling rings, a charge chute for the delivery of wastes and an encapsulating material into the drum, a vibratable platform supporting the drum beneath the charge chute, an inflatable support for the platform for lifting the drum against a surface at the bottom of the charge chute and for axially compressing the rolling rings by a predetermined amount to maintain the end of the drum in sealing engagement about the charge chute, and vibration means for vibrating the platform to agitate the contents of the drum but without breaking the seal at the charge chute due to the precompression of the rolling rings. Conveniently, the inflatable support comprises a plurality of pneumatic cushions beneath the platform and connected to a common compressed gas supply.

The invention will be described further, by way of example, with reference to the accompanying schematic drawing which depicts an embodiment of an apparatus for encapsulating radioactive wastes.

In the drawing a drum 1 to receive radioactive wastes and a cement or grout is shown in phantom outline. The drum 1 comprises a cylindrical vessel having rolling rings 10 which is open at its upper end and located on a platform 2. The platform 2 is provided with three feet 3 spaced apart at equal intervals around the periphery of the drum. Each foot 3 is mounted on a respective pistonless pneumatic actuator. Each actuator comprises a cushion 4 which is connected through a respective hose pipe 5 to a manifold 6 which in turn is connected to compressed gas supply, conveniently compressed air, via isolation valve 7. The latter can be positioned at a location remote from the drum 1. For example, in the encapsulation of radioactive wastes, the drum can be located within a cave and behind shielding with the valve 7 outside the cave.

In use, the drum 1 is positioned on the platform 2 with the cushions 4 in a deflated condition such that the upper open end of the drum can be located beneath the end of a charge chute 8. The cushions 4 are then inflated from the gas supply via valve 7 whereby to lift the drum such that its upper open end makes sealing contact with a plate 9 at the bottom of the charge chute and compress the rolling rings 10 by a pre-determined amount. Wastes together with cement or grout are delivered into the drum and at the same time a vibrator or vibrators 11 secured to and mounted under platform 2 is or are operated to thereby vibrate the drum and its contents but without breaking the sealing engagement between the end of the drum and the charge chute due to the precompression of the rolling rings. The amplitude of vibration is small, for example it can be a fraction of a millimetre and the frequency can be in the range 20 to 50 cycles per second. The vibration serves to pack efficiently the contents of the drum and assists in the distribution of the cement or grout about the radioactive wastes thereby avoiding voids and gaps within the drum. The sealing engagement serves to prevent possible contamination of the exterior of the drum during filling. After filling the cushions are deflated to permit removal of the drum.

We claim:

1. Apparatus for the encapsulation of harmful waste products, comprising a drum formed with axially compressible rolling rings, a charge chute for the delivery of wastes and an encapsulating material into the drum, a vibratable platform supporting the drum beneath the charge chute, an inflatable support means for the platform for lifting the drum against a surface at the bottom of the charge chute and for axially compressing the rolling rings by a predetermined amount to maintain the end of the drum in sealing engagement about the charge chute, and vibration means for vibrating the platform to agitate the contents of the drum but without breaking the seal at the charge chute due to the pre-compression of the rolling rings.

2. Apparatus accordiing to claim 1 in which the inflatable support comprises a plurality of pneumatic cushions beneath the platform and connected to a common compressed gas supply.

3. Apparatus according to claim 1 in which the vibration means comprises at least one vibrator secured to and mounted under the platform.

* * * * *